US006004148A

United States Patent [19]

Waible

[11] Patent Number: 6,004,148

[45] Date of Patent: Dec. 21, 1999

[54] ELECTRIC MATING CONNECTOR INSERT

[75] Inventor: Thomas Waible, Waldbronn, Germany

[73] Assignee: Taller GmbH, Walbronn, Germany

[21] Appl. No.: 08/827,825

[22] Filed: Apr. 11, 1997

[30] Foreign Application Priority Data

Apr. 12, 1996 [DE] Germany ..... 196 14 453

[51] Int. Cl.[6] ..... H01R 13/44

[52] U.S. Cl. ..... 439/140; 439/502

[58] Field of Search ..... 439/140, 141, 439/136, 502, 188

[56] References Cited

U.S. PATENT DOCUMENTS

| | | | |
|---|---|---|---|
| 2,735,906 | 2/1956 | Avrunin | 439/188 |
| 5,599,204 | 2/1997 | Glassford | 439/502 |

FOREIGN PATENT DOCUMENTS

| | | | |
|---|---|---|---|
| 73 18 518 U | 5/1973 | Germany . | |
| 27 01 188 | 7/1978 | Germany . | |
| 431653 | 7/1935 | United Kingdom . | |
| 1480108 | 7/1977 | United Kingdom | 439/140 |

*Primary Examiner*—Michael L. Gellner
*Assistant Examiner*—Antoine Ngandjui
*Attorney, Agent, or Firm*—Baker & Daniels

[57] ABSTRACT

An electrical mating connector for connecting a safety plug have prongs connected to a plurality of conductors. The connector comprises a coupling body having an end face disposed on a surface thereof, a plurality of lugs disposed in the coupling body, and a protective insert movably mounted in the coupling body. The lugs respectively connect to a plurality of conductors and are set back at a predetermined distance from the coupling end face. The protective insert has a mating end face and a plurality of openings disposed on the mating end face and adapted to accept the prongs of the safety plug. The protective insert moves between a first position wherein the protective insert end face is extended outwardly from the end face of the coupling body and the lugs such that the prongs of a safety plug coupled to the protective insert are out of contact with the lugs and a second position wherein the protective insert is inserted into the coupling body toward the lugs such that the prongs of the safety plug coupled to the protective insert are in contact with the lugs. The conductors are disposed in a cord which connects to the coupling body.

3 Claims, 4 Drawing Sheets

ELECTRIC MATING CONNECTOR INSERT

BACKGROUND OF THE INVENTION

1. Field of the Invention

The present invention relates to an electric mating connector insert for an electric mating connector or wall outlet.

2. Description of the Related Art

Inserts of the categorical type are previously known—notably on the U.S.-American market. They represent the core of an electric plugging device where the categorical inserts are injected-molded or cast, along with the stripped ends of the electric conductors and of the ground conductor of a duplex or triplex cord, with an insulating material forming a gripping component.

In handling this electric plugging device, i.e., inserting it in a mating connector or wall outlet, a safety plug having protruding prongs is inserted in complementary slots disposed on the end face of the mating connector or wall outlet. When the prongs advance to a preset depth, the prongs make electric contact with the lugs of the mating connector.

According to the prior connector (illustrated in FIGS. 9–11), contact between the prongs of the safety plug and the lugs of the mating connector is established before the space between the end faces of the safety plug and the mating connector has sufficiently been closed to preclude any risk of touching the prongs.

Thus, a problem associated with the prior mating connectors is that, electric contact exists while the space between the end faces of the mating connector and the safety plug is still sufficiently large enough to allow inadvertent touching of the prongs. Hence, a person inserting the safety plug in the mating connector or outlet risks being exposed to electrical shocks.

SUMMARY OF THE INVENTION

The objective underlying the present invention is to provide a mating connector and a wall outlet of the categorical type wherein the aforementioned risk is precluded.

This objective is met by the features of the present invention wherein the mating connector, or the wall outlet, features a kind of protective cap jutting out from the end face of the mating connector, or the wall outlet, into which the safety plug is first inserted loosely and moves into the mating connector body as the prongs of the safety plug continue to be advanced into the lug. Once the end face of the safety plug bears on the corresponding end face of the mating connector, or the wall outlet, the protruding end face of the protective cap is flush with the end face of the mating connector, or the wall outlet. The prongs of the safety plug are ultimately shielded before touching the lugs, and they remain shielded as long as they are touching the lugs. When pulling the safety plug off the mating connector, or the wall outlet, the protective cap moves outwardly, due to its movable mounting, such that it is pulled away from the mating connector, or the wall outlet, end face and is captively retained in place by an integrated catch.

BRIEF DESCRIPTION OF THE DRAWINGS

The invention is more fully explained hereafter with the aid of the drawings, wherein.

DETAILED DESCRIPTION OF THE INVENTION

Figure 9:
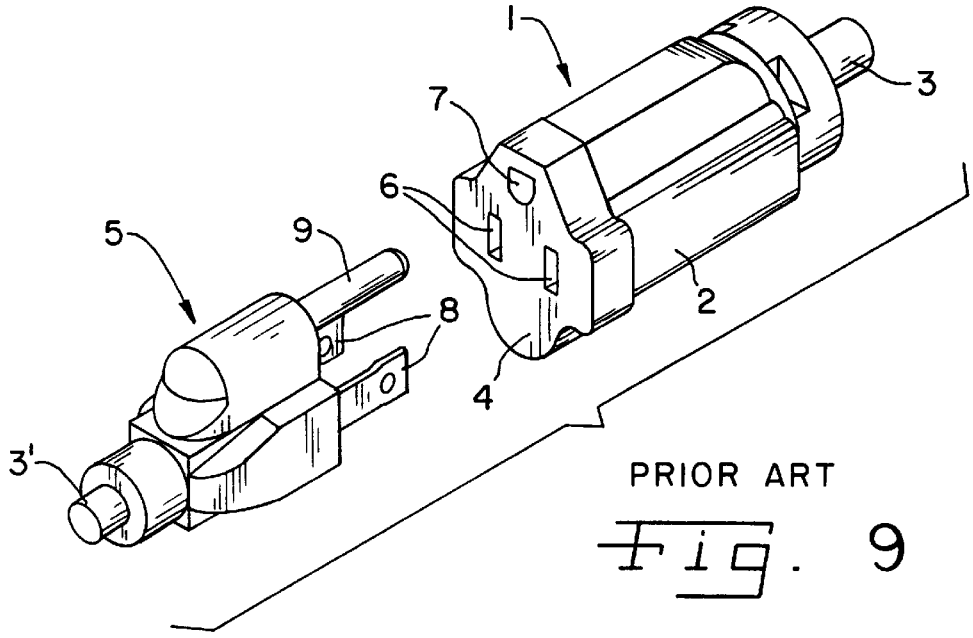
PRIOR ART Fig. 9
FIG. 9 is a perspective view of a safety plug and a conventional mating connector.
Figure 10:
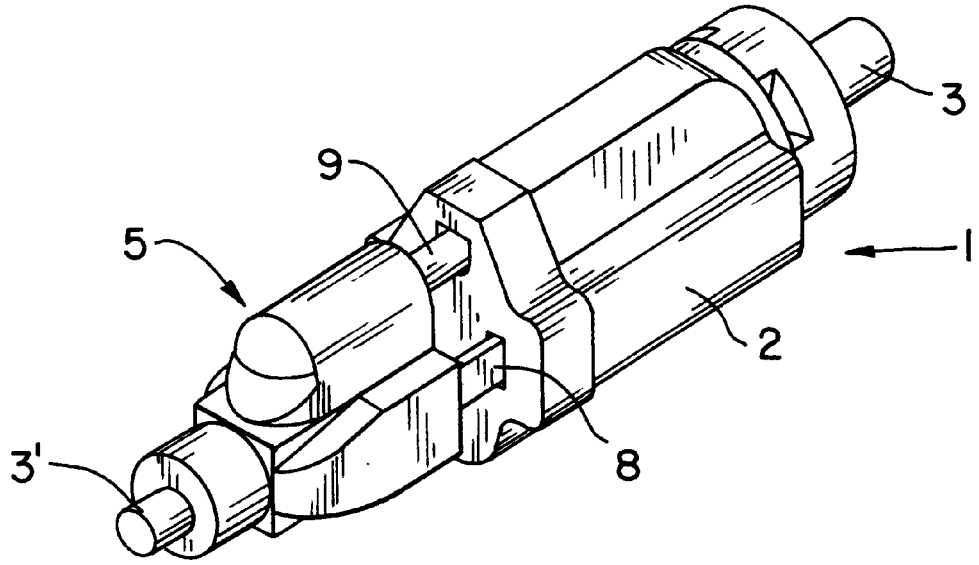
PRIOR ART Fig. 10
FIG. 10 is a perspective view of a safety plug partially inserted into a conventional mating connector.
Figure 11:
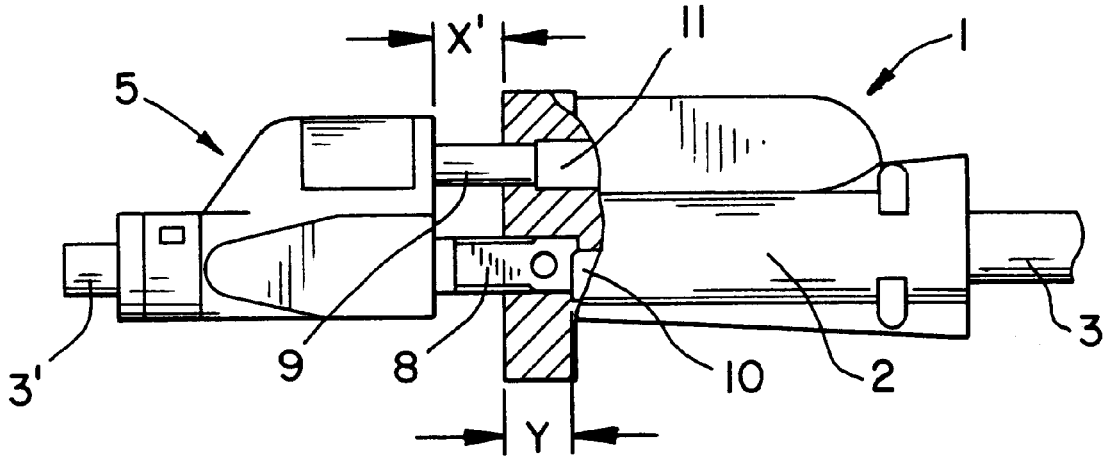
PRIOR ART Fig. 11
FIG. 11 is a sectional view of a safety plug partially inserted into a mating connector wherein electrical contact has been established.

A conventional mating connector 1 illustrated in FIGS. 9–11 comprises a coupling 2 which is connected to a triplex cord 3 at one end and features an end face 4 on the other end in which a safety plug 5 can be inserted. The interior of coupling 2 includes lugs to which the conductors of the cord 3 are connected. End face 4 includes outwardly open slots 6, 7 associated with the three conductors of the cord. The slots 6 are rectangular in cross section while slot 7 for the grounding conductor has a semicircular cross section. The safety plug 5 has prongs 8, 9 including conductors 8 having rectangular cross section and a grounding conductor 9 having a round cross section. The safety plug 5 is connected to a cord 3'.

As shown in FIGS. 10 and 11, the safety plug 5 is inserted in the coupling 2. Prongs 8, 9 touch the lugs 10, 11 inside the coupling 2 before the end face of safety plug 5 bears on the end face 4. As follows from FIGS. 10 and 11, an open space with distance X remains for open access between the coupling 2 and safety plug 5, where contact with the user is possible in case of careless handling. The reason for the open space is that the distance Y of the lugs 10 from the end face is less than the length of the conductor 8 protruding beyond the end face of safety plug 5.

The illustrations of the configuration in FIGS. 1–5 correspond to that in FIGS. 9–11. A safety plug 5 is adapted to be inserted in coupling 2A of mating connector 1A.

Figure 1:
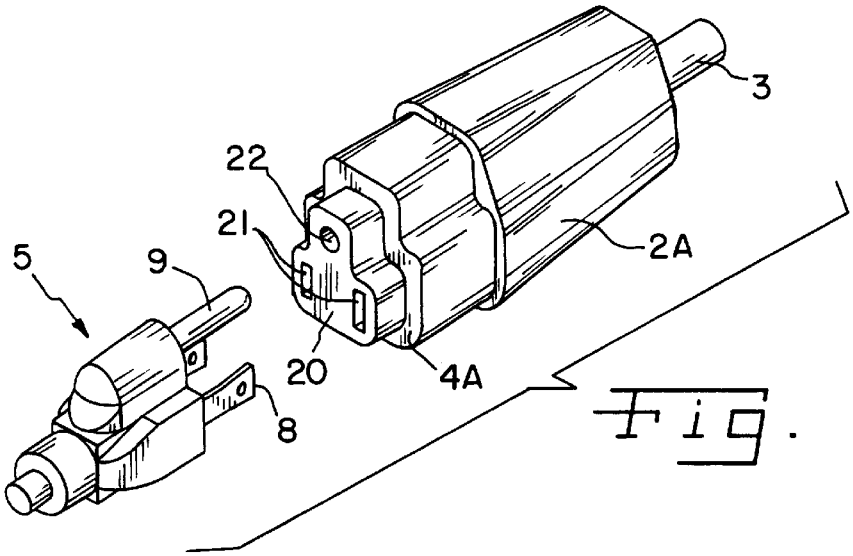
FIG. 1 is a perspective view of a safety plug and a mating connector of the present invention.
Figure 2:
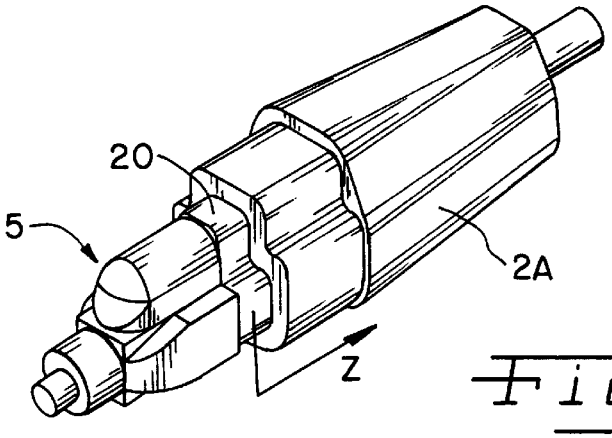
FIG. 2 is a perspective view of the safety plug connected to the mating connector of the present invention.
Figure 3:
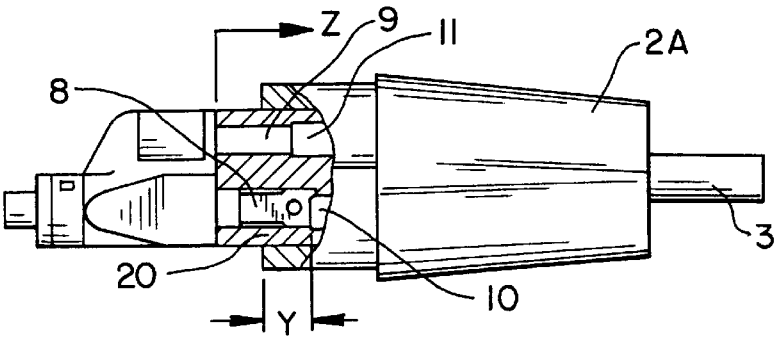
FIG. 3 is a sectional view of a safety plug connected to the mating connector of the present invention.
Figure 4:
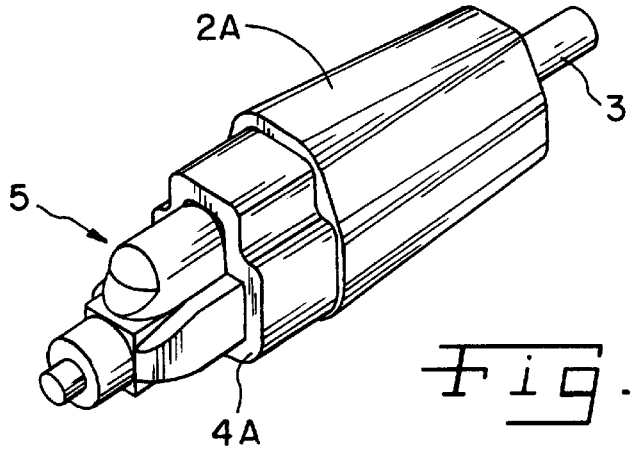
FIG. 4 is a perspective view of a safety plug and a mating connector of the present invention wherein the protective insert has been inserted to establish electrical contact.
Figure 5:
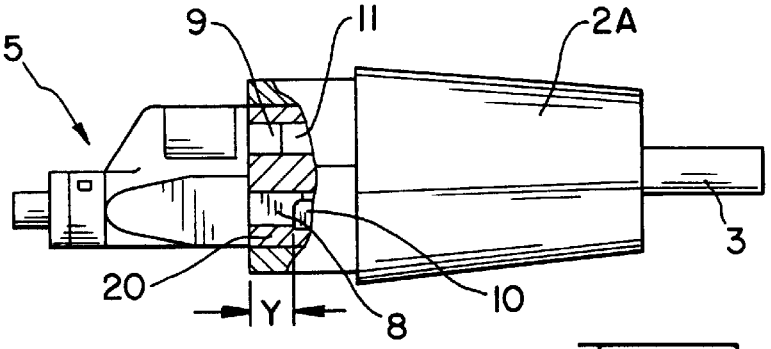
FIG. 5 is a sectional view of a safety plug and a mating connector wherein the protective insert has been inserted and electrical contact has been established.

Present coupling 2A, unlike the prior art illustrated in FIGS. 9–11, features a protective insert 20 movably mounted in coupling 2A and coordinated with the coupling end face 4A. Protective insert 20 comprises slots 21, 22 corresponding to the slots 6, 7 and adapted to receive the prongs 8, 9 of safety plug 5. When safety plug 5 is inserted in coupling 2A, the prongs 8, 9 first engage the slots 21, 22 of protective insert 20 and are protected all around prior to making contact with lugs 10, 11. As safety plug 5 is pushed in further, protective insert 20 is pushed into the interior of coupling 2A in the direction of arrow Z as shown in FIG. 3 until safety plug 5 bears on end face 4A in a fully seated position as shown in FIGS. 4–5.

The provision of protective insert 20 ensures that prongs 8, 9 of the safety plug 5 are shielded prior to and as long as they are in contact with lugs 10, 11.

When pulling safety plug 5 off coupling 2A, the protective insert 20 is pulled outwardly from the end face 4A, due to its movable mounting, until engaging a catch on coupling 2A. The catch in coupling 2A may include molded portions which abut protective insert 20 so as to retain protective insert 20 when safety plug 5 is pulled from coupling 2A. Springs, or like mechanisms, may also be disposed in coupling 2A and arranged so as to urge protective insert 20 in the outward position with respect to end face 4A when the safety plug 5 is pulled from coupling 2A.

FIGS. 1–5 show a configuration for a triplex mains cable/cord 3'. It is to be understood that the present invention is suited for use with a duplex cord.

Figure 6:
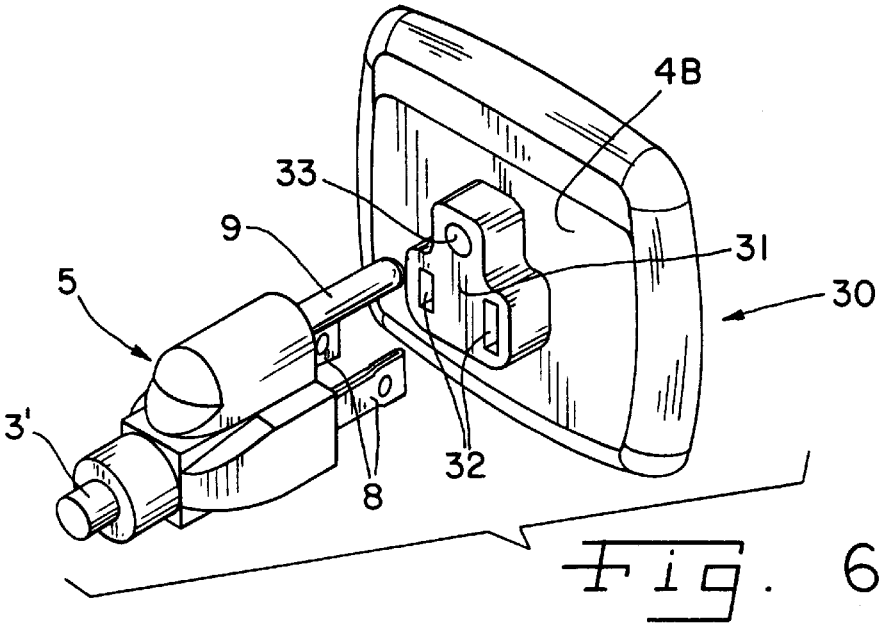
FIG. 6 is a perspective view of a safety plug and a wall outlet of the present invention.
Figure 7:
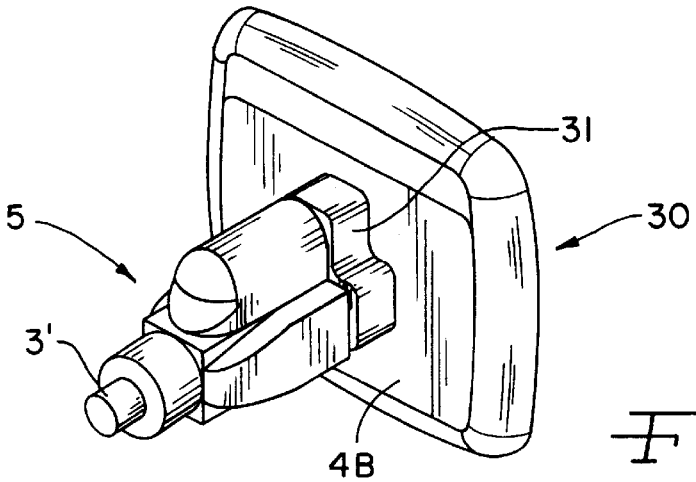
FIG. 7 is a perspective view of a safety plug and a wall outlet of the present invention wherein the safety plug has been inserted into the wall outlet but electrical contact has not been established.
Figure 8:
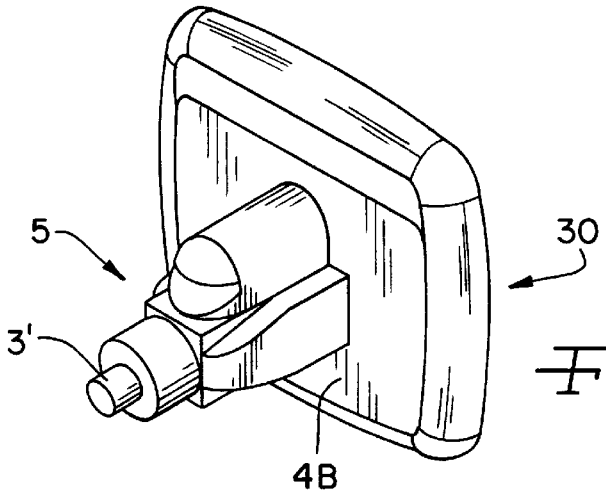
FIG. 8 is a perspective view of a safety plug inserted into wall outlet of the present invention wherein electrical contact has been established.

FIGS. 6–8 show the inventional configuration used with a wall outlet 30. A safety plug 5 connected to a cord 3' is adapted to be plugged in the wall outlet 30.

Analogous to the arrangement shown in FIGS. 1–5, the wall outlet 30 features a protective insert 31 which is movably mounted in outlet 30 and coordinated with the wall outlet 30. Protective insert 31 comprises slots 32, 33 corresponding with the slots of wall outlet 30 and adapted to receive the prongs 8, 9 of safety plug 5. When the safety plug 5 is plugged into the wall outlet 30, prongs 8, 9 first engage the slots 32, 33 of protective insert 31 as shown in FIG. 7 and are protected all around prior to making contact with the lugs in the wall outlet 30. Pushing the safety plug 5 in further causes the protective insert 31 to be pushed into the interior of wall outlet 30 until safety plug 5 rests on the wall outlet face 4B in a fully seated position as shown in FIG. 8.

The provision of protective insert 31 ensures that prongs 8, 9 of safety plug 5 are shielded as soon as and as long as the plug 5 remains in the outlet.

When pulling safety plug 5, protective insert 31 again follows along, due to its movable mounting, until engaging a catch on the inside of wall outlet 30. The catch and spring assembly in wall outlet 30 is similar to that in coupling 2A.

I claim:

1. An electrical mating connector for connecting a safety plug having a body and a plurality of prongs, comprising:

a coupling body having an end face disposed on a surface thereof;

a plurality of lugs disposed in said coupling body, said lugs continuously connected respectively to a plurality of conductors, said lugs set back at a predetermined distance from said coupling end face;

a protective insert movably mounted in said coupling body, said protective insert having a mating end face and a plurality of openings disposed on said mating end face and adapted to accept and sheath the prongs of the safety plug, said protective insert movable between a first position wherein said protective insert end face is extended outwardly from said end face of said coupling body and said lugs such that the prongs of a safety plug when fully sheathed in said openings of said protective insert are out of contact with said lugs and a second, fully seated position wherein said protective insert is inserted into said coupling body toward said lugs, the plug is in a fully seated position in the connector and the prongs of the safety plug coupled to said protective insert are in direct physical contact with said lugs.

2. A connector as claimed in claim 1 wherein said conductors are disposed in a cord which connects to said coupling body.

3. An electrical mating connector for connecting a safety plug having a body and a plurality of prongs, comprising:

a coupling body having an end face disposed on a surface thereof;

a plurality of lugs disposed in said coupling body, said lugs continuously connected respectively to a plurality of conductors, said lugs set back at a predetermined distance from said coupling end face;

a protective insert movably mounted in said coupling body, said protective insert having a mating end face and a plurality of openings disposed on said mating end face and adapted to accept and sheath the prongs of the safety plug, said protective insert movable between a first position wherein said protective insert end face is extended outwardly from said end face of said coupling body and said lugs such that the prongs of a safety plug when fully sheathed in said openings of said protective insert are out of contact with said lugs and a second, fully seated position wherein said protective insert is inserted into said coupling body toward said lugs, the plug is in a fully seated position in the connector and the prongs of the safety plug coupled to said protective insert are in direct physical contact with said lugs, the body of the safety plug completely disposed outside of said coupling body when said insert is in said fully seated position.

* * * * *